US007547841B2

(12) United States Patent
Furuta

(10) Patent No.: US 7,547,841 B2
(45) Date of Patent: Jun. 16, 2009

(54) MUSIC COMPOSITION INSTRUCTION SYSTEM

(75) Inventor: Seiichi Furuta, Anjo (JP)

(73) Assignee: Denso Corporation, Kariya (JP)

( * ) Notice: Subject to any disclaimer, the term of this patent is extended or adjusted under 35 U.S.C. 154(b) by 560 days.

(21) Appl. No.: 11/100,383

(22) Filed: Apr. 7, 2005

(65) Prior Publication Data

US 2005/0223878 A1 Oct. 13, 2005

(30) Foreign Application Priority Data

Apr. 8, 2004 (JP) ..... 2004-114567

(51) Int. Cl.
*A63H 5/00* (2006.01)
*G04B 13/00* (2006.01)
*G10H 7/00* (2006.01)

(52) U.S. Cl. ..... 84/609; 455/435.1

(58) Field of Classification Search ..... 84/609; 717/174; 455/435.1, 451
See application file for complete search history.

(56) References Cited

U.S. PATENT DOCUMENTS

| | | | | |
|---|---|---|---|---|
| 6,248,946 | B1 * | 6/2001 | Dwek | 84/609 |
| 6,942,143 | B1 * | 9/2005 | Iida et al. | 235/379 |
| 6,996,390 | B2 * | 2/2006 | Herley et al. | 455/345 |
| 7,251,452 | B2 * | 7/2007 | Stumphauzer, II | 455/3.06 |
| 2001/0018858 | A1 * | 9/2001 | Dwek | 84/609 |
| 2001/0023433 | A1 | 9/2001 | Natsubori et al. | |
| 2001/0025256 | A1 * | 9/2001 | Oliphant et al. | 705/26 |
| 2002/0152878 | A1 * | 10/2002 | Akashi | 84/609 |
| 2002/0164973 | A1 * | 11/2002 | Janik et al. | 455/403 |
| 2002/0183059 | A1 * | 12/2002 | Noreen et al. | 455/427 |
| 2003/0014767 | A1 * | 1/2003 | Stumphauzer, II | 725/131 |
| 2003/0110057 | A1 * | 6/2003 | Pisz | 705/1 |
| 2003/0221541 | A1 * | 12/2003 | Platt | 84/609 |
| 2004/0002310 | A1 * | 1/2004 | Herley et al. | 455/179.1 |
| 2005/0201254 | A1 * | 9/2005 | Looney et al. | 369/124.01 |
| 2005/0262528 | A1 * | 11/2005 | Herley et al. | 725/19 |

FOREIGN PATENT DOCUMENTS

| | | |
|---|---|---|
| JP | A-08-190345 | 7/1996 |
| JP | A-H11-288420 | 10/1999 |
| JP | A-2000-331025 | 11/2000 |
| JP | A-2001-184360 | 7/2001 |
| JP | A-2002-216035 | 8/2002 |
| JP | A-2002-278566 | 9/2002 |
| JP | A-2002-366167 | 12/2002 |
| JP | A-2003-150632 | 5/2003 |

OTHER PUBLICATIONS

"Amazon.com," Wikipedia, Dec. 2008.*
"Collaborative filtering," Wikipedia, Dec. 2008.*
Office Action dated Feb. 10, 2009 in corresponding Japanese patent application No. 2004-114567 (and English translation).

* cited by examiner

*Primary Examiner*—Jeffrey Donels
(74) *Attorney, Agent, or Firm*—Posz Law Group, PLC

(57) ABSTRACT

A music composition introduction system consists of a user's audio system and a center for managing music composition information, both of which communicate with each other. The audio system has a preference database storing user's preference data. The center receives this preference data, and retrieves music composition information meeting the preference data from a music composition information database. The center then sends music composition information data corresponding to the retrieved music composition information to the audio system. This structure of this system can effectively introduce to each user a music composition meeting the user's preference.

10 Claims, 5 Drawing Sheets

MUSIC COMPOSITION INSTRUCTION SYSTEM

CROSS REFERENCE TO RELATED APPLICATIONS

This application is based on and incorporates herein by reference Japanese Patent Application No. 2004-114567 filed on Apr. 8, 2004.

FIELD OF THE INVENTION

The present invention relates to a music composition introduction system that extracts a music composition meeting musical preference of a user to thereby introduce the extracted music composition to the user.

BACKGROUND OF THE INVENTION

There are recently practically used in vehicles audio devices having as storage medium hard disk drives (HDDs) of rewritable large memory volumes. These audio devices can reproduce music composition data stored in storage media such as CDs possessed by users and also store those music composition data in HDDs. The users can use the HDDs as a music server by storing the preferred music composition data from the CDs to the HDDs.

Further, downloading music composition data via a network becomes popular as means for obtaining the music composition data from other than the storage media such as CDs. In this case, a user accesses a server for distributing the music composition data and searches necessary music compositions using music composition names or artist names. After it is determined that the retrieved music composition accords with the one the user requests, downloading of the relevant music composition data is started.

When the music composition data is accumulated from the CDs in the HDDs, the user stores the HDDs with music composition data from the CDs that the user already obtains. Namely, new unknown music composition data is never stored. Similarly, in the case of downloading the music composition data, the user previously needs to know a targeted music composition and knows information for designating the targeted music composition.

Patent Document 1 describes a music distribution system that, when a user previews a music composition demo, the user can easily download the music composition data corresponding to the demo the user is previewing or listening to.

Patent Document 1: JP-2002-318587 A

However, there are not so many opportunities for the user to come across an impressed music demo while the demo is being previewed. Namely, coming across the impressed music depends on a chance, so that this music distribution system has a problem in efficiency.

Further, existing music compositions are so many and new music compositions are continuously released day by day. Therefore, it is very difficult for a user to select a music composition that the user prefers.

SUMMARY OF THE INVENTION

It is an object of the present invention to provide a music composition introduction system that is capable of effectively introducing into a user a music composition meeting the user's preference.

To achieve the above object, a music composition introduction system that extracts and introduces music composition information meeting a musical preference of a user is provided with the following. A terminal is included for the user; and a center is also included for managing music composition information. Here, the terminal includes the following: a storing unit that stores preference data relating to the musical preference of the user; an obtaining unit that obtains, from the center, music composition information data relating to a music composition that meets the preference data; a music reproducing unit that reproduces the music composition based on the obtained music composition information data; and a user-end communicating unit that sends the preference data to the center and receives the music composition information data from the center. Further, the center includes the following: a music composition information database that stores music composition information; a retrieving unit that obtains the preference data that is stored in the storing unit and retrieves, from the music composition information database, music composition information that meets the obtained preference data; and a center-end communicating unit that sends the music composition information data corresponding to the retrieved music composition information to the terminal and receives the preference data from the terminal.

This structure of this system can effectively introduce to each user a music composition meeting the user's preference.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS

Figure 1:
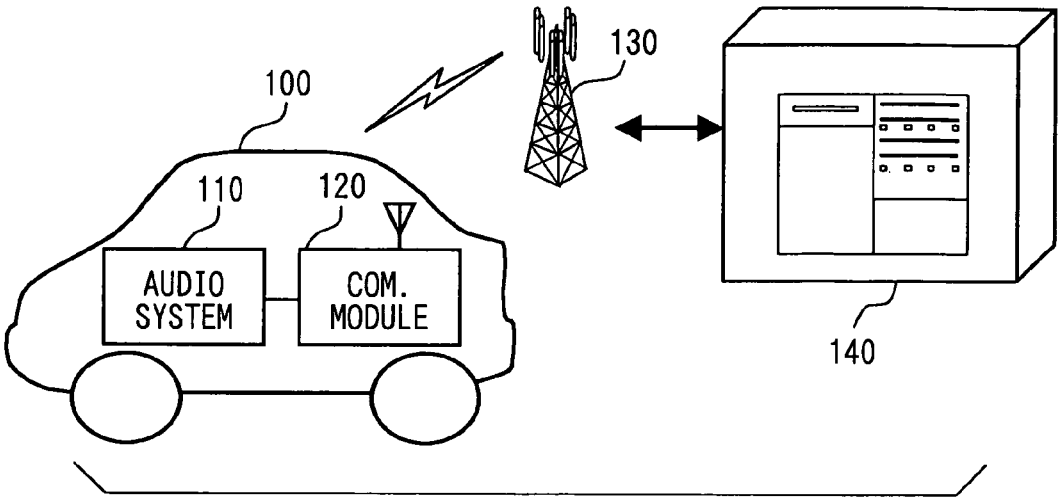
FIG. 1 is a block diagram showing a schematic structure of a music composition introduction system according to an embodiment of the present invention.

A music composition introduction system according to an embodiment of the present invention will be explained below. In this embodiment, as shown in FIG. 1, a music composition introduction system uses, as a user terminal, an audio system 110 and a communications module 120 in a subject vehicle 100. Music composition information is introduced to this user via a relay station 130 from a music composition management center 140. The user then buys the music composition information when the user likes it. Here, this system can be directed to any application other than the vehicle as long as the application has an audio system with a communicating method to the music composition management center. For instance, the music composition information can be introduced to a user who has an audio system in the user's home (or in a stationary location) by using its communicating method.

Figure 2:
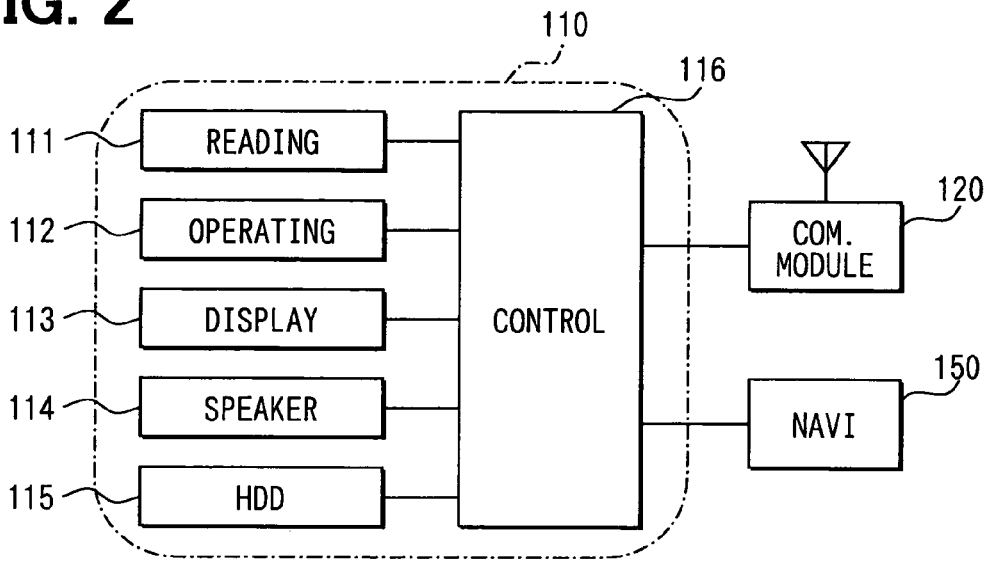
FIG. 2 is a block diagram showing a schematic structure of an audio system mounted in a vehicle.

Further, the audio system 110 includes a data reading unit 111, an operating unit 112, a display 113, a speaker 114, a hard disk drive (HDD) 115, and a control unit 116, as show in FIG. 2. This audio system 110 connects to a navigation system 150 to thereby obtain a vehicle's position, a weather condition at this vehicle's position, a date and hour, or the like.

The reading unit 111 reads music composition data stored in a storage medium such as a CD, a MD, and a DVD to thereby output it to the control unit 116. The operating unit 112 includes a sound operating unit for speech operation and various switches for operations. These operations include reproducing or stopping music composition data stored in the storage medium and the HDD 115, and instructing purchase of the music composition introduced through the communication with the music composition management center 140. Further, in this embodiment, using this operating unit 112, artists and music genres meeting the user's preference, and the user's data such as the user's age or gender are previously inputted to be thereby stored in the HDD 115.

The display 113 is, for instance, a liquid crystal display unit for displaying an order, a name, a artist name of a music composition that is read from the HDD 115 or the data reading unit 111 to be reproduced. The speaker 114 outputs reproduction sounds or the like when a music composition is reproduced. The HDD 115 includes a hard disk as a storage medium. When the data reading unit 111 reads music composition data, the HDD 115 writes the read music composition data in the hard disk or reads the written music composition data. Further, in this embodiment, the music composition information data is received from the center 140, the music composition information data is also stored in the hard disk.

Further, the hard disk stores preference data that includes user information and reproduced music composition related data. The user information includes registration of each user's preference relating to music. The reproduced music composition related data relates to music compositions the user actually listened to.

The control unit 116 instructs the data reading unit 111 and the HDD 115 regarding music composition data to be read, and generates music composition reproducing signals or the like based on the music composition data read by the data reading unit 111 or the HDD 115 to thereby output them to the display 113 and the speaker 114. Further, the control unit 116 communicates with the center 140 via the communications module 120 to thereby send the preference data or receive the introduced music composition information data. In FIG. 2, interfaces (e.g., D/A converter) between the control unit 116 and the speakers or the like the control unit 116 connects to are not shown.

Figure 3:
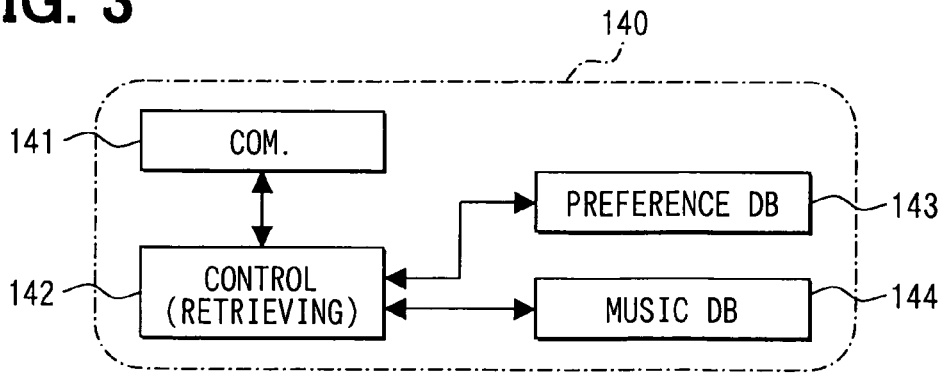
FIG. 3 is a block diagram showing a schematic structure of a music information management center.

The center 140 is shown regarding its structure in FIG. 3. The center 140 includes a communications unit 141 that communicates with the communications module 120 of the vehicle 100, a music composition information database 144 including multiple music composition data, a preference database 143 storing collected preference data of individual users, and a control unit 142. This control unit 142 receives the preference data indicating musical preference of each of users, and retrieving a music composition meeting the user's preference to thereby send it to the vehicle 100 as a music composition to be introduced.

Here, the music composition information database 144 is classified into albums and singles. With respect to albums, music composition data included in an album is stored as a unit and the individual music composition data is stored. Further, the music composition data is stored while being classified by an artist, a composer, a lyric writer, a music genre, a label name (music company name), or the like. This makes it easy to retrieve a music composition meeting the preference data of each user. Further, each music composition data further includes dependence data when each music composition data is determined to be listened to depending on a date and hour, a season, a weather condition, a place, or the like, from the reproduced music composition related data in the user's preference data. Further, the dependence data is also included when a music composition provider designates a certain condition such as a date and hour, a season, a weather condition, a place, or the like under which the relevant music composition is recommended to be listened to.

Figure 4:
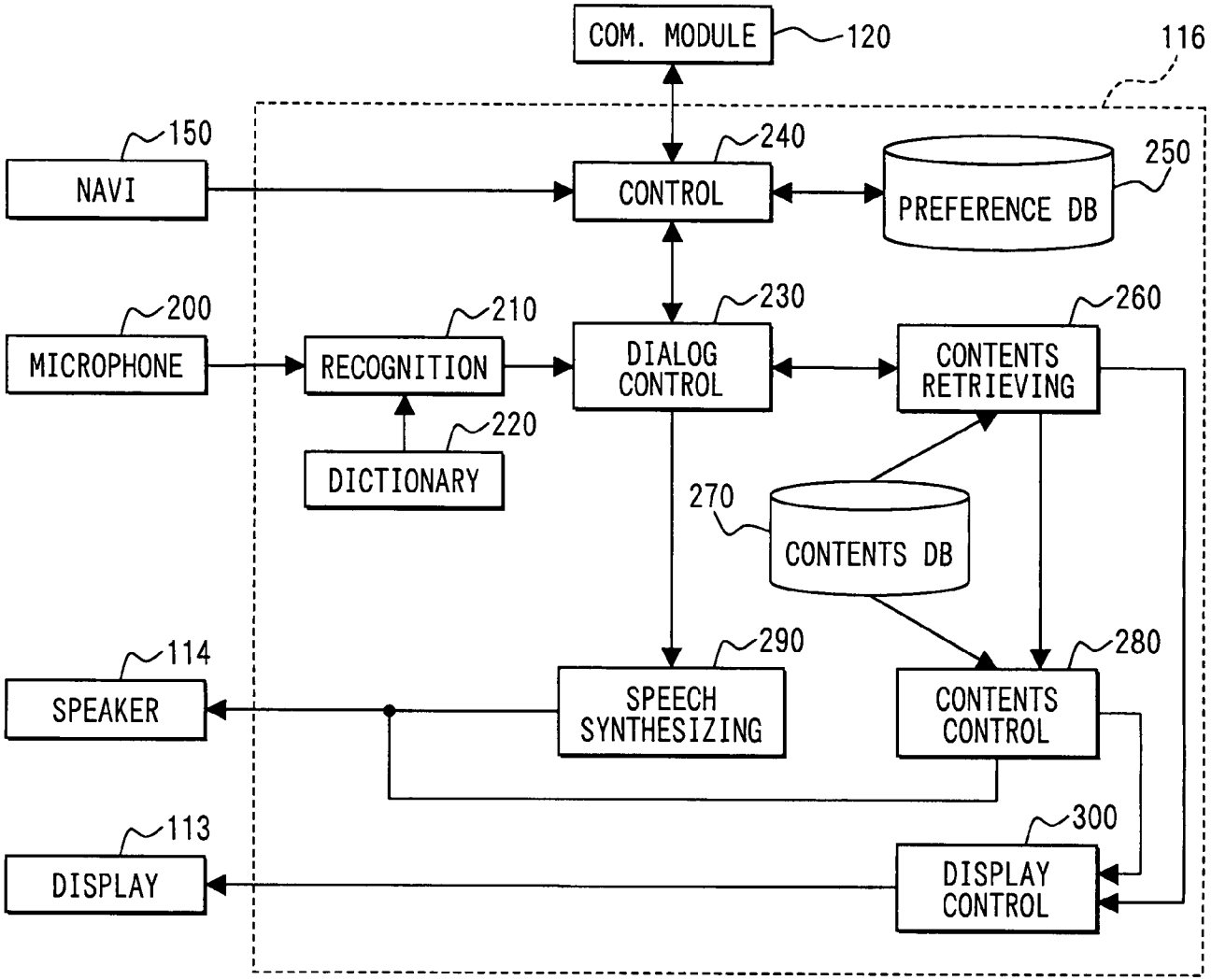
FIG. 4 is a block diagram showing a structure of a control unit in a case where an operating unit is configured to be a sound operating unit.

FIG. 4 shows a detailed structure of the control unit 116 in a case where the operating unit 112 is configured as a sound operating unit. This structure includes a microphone 200 for inputting speeches uttered by a user. The speaker 114 outputs a reply to the uttered speeches to thereby enable interactive speech operation. This interactive speech dialog operation can be performed without disturbing driving operation of the user and easily select speeches to be inputted.

The control unit 116 includes a speech recognition unit 210 for recognizing speeches using the sound signals inputted through the microphone 200. The speech recognition unit 210 recognizes the inputted speeches based on dictionaries or grammars provided from a recognition dictionary 220. The recognition dictionary 220 previously stores dictionaries and grammars relating to words and phrases used in operations such as reproducing music compositions, stopping reproduction, downloading, or the like.

A dialog control unit 230 controls execution of speech dialog. Namely, when a user commands a given operation by speech or by switch manipulation, the dialog control unit 230 starts to execute speech dialog scenario corresponding to the commanded operation. Namely, the dialog control unit 230 outputs, to the user, data relating to speech contents to a speech synthesizing unit 290 so as to conduct inquiry, assistance, confirmation, report, or the like. The speech synthesizing unit 290 thereby synthesizes speeches following the speech contents and causes the speaker 114 to output them.

Suppose a case that reproducing a specific music composition stored in the HDD 115 from the storage medium such as a CD is commanded by the above speech dialog scenario. In this case, the dialog control unit 230 instructs a recommended music composition control unit 240 to store related data relating to the music composition whose reproduction is commanded. Namely, the recommended music composition control unit 240 stores reproduced music composition related data relating to the reproduced music composition as preference data in the preference database 250. The music composition that the user actually listens to indicates music preference of the user. By using this music composition as a key, music compositions of the same artist, or music compositions of the same music genre can be thereby introduced as a music composition meeting with the user's preference.

Further, the reproduced music composition related data includes at least one of a name, an artist, a music genre, a label name, a date and hour when reproduced, a weather condition under which reproduced, and a place where reproduced. It is because these data can be a key to retrieve a music composition to be introduced. For instance, a certain label or music company focuses on a specific genre or provides projected CDs in series. In this case, music compositions having the same label name can be extracted as a music composition to be introduced. Further, with respect to a date and hour, a season, a weather condition, and a place, these indicate a condition where the user listens to a music composition. To a user who often listens to a music composition in the night, music compositions that are often listened to in the night are introduced.

Further, when a certain music composition is listened to in a given condition of a date and hour, a season, a weather condition, a place, the certain music composition has a certain conditional dependence. When this conditional dependence is included in the reproduced music composition related data, this conditional dependence can be used for extracting a proper music composition. Namely, a music composition is extracted from the reproduced music composition related data of multiple users depending on a condition where the relevant user is situated.

Further, the preference database 250 is previously inputted with a favorite artist, a favorite music genre, user data including an age and gender, or the like in addition to the above reproduced music composition related data, and also stores the inputted user information as the preference data. Further, there is a case where favorite music compositions are grouped as a registered list. In this case, the list can be stored in the preference database 250 as My-List.

Further, this embodiment supposes a case where multiple users use the audio system 110 in common in the vehicle 100. Therefore, multiple preference data of the multiple users are separately stored. For instance, when user information is registered, each of user IDs (or user identification numbers) is inputted. The preference data is thereby separately registered with respect to each of the user IDs. Identification of the users can be also conducted based on the information inputted as voice patterns or finger patterns.

Further in this embodiment, when the multiple users register, audio setting information in reproducing music compositions in the audio system 110 is also separately stored with respect to each of the users. This audio setting information includes data relating to sound volume balances in multiple speakers, mode setting for a DSP or an equalizer, or manual settings. Preferences in the audio setting information are differentiated depending on each of the users. Therefore, the user is determined using the user ID, voice patterns or the like, and then the audio setting is changed based on the audio setting information corresponding to the determined user.

Further, the dialog control unit 230 gives information designating a music composition to be reproduced to a contents retrieving unit 260. The contents retrieving unit 260 retrieves the music composition to be reproduced from a contents database 270 based on the given information. Here, the contents database 270 consists of multiple music composition data stored in the HDD 115. The retrieving result in the contents retrieving unit 260 is given to the contents control unit 280, and the contents control unit 280 extracts music composition data, which is retrieved by the contents retrieving unit 260, from the contents database 270. Based on the extracted music composition data, relevant music composition reproduction signals are generated to be outputted to the speaker 114.

Here, the retrieving result in the contents retrieving unit 260 or information related to the reproduced music composition by the contents control unit 280 is given to a display control unit 300. The display control unit 300 then displays the information on the display 113.

In the above explanation, when a music composition stored in the contents database 270 in the HDD 115 is initially reproduced, reproduced music composition related data of this music composition is stored in the preference database 250. Further, when a music composition stored in a storage medium such as a CD is initially reproduced, reproduced music composition related data of this music composition can be also stored in the preference database 250.

Figure 5:
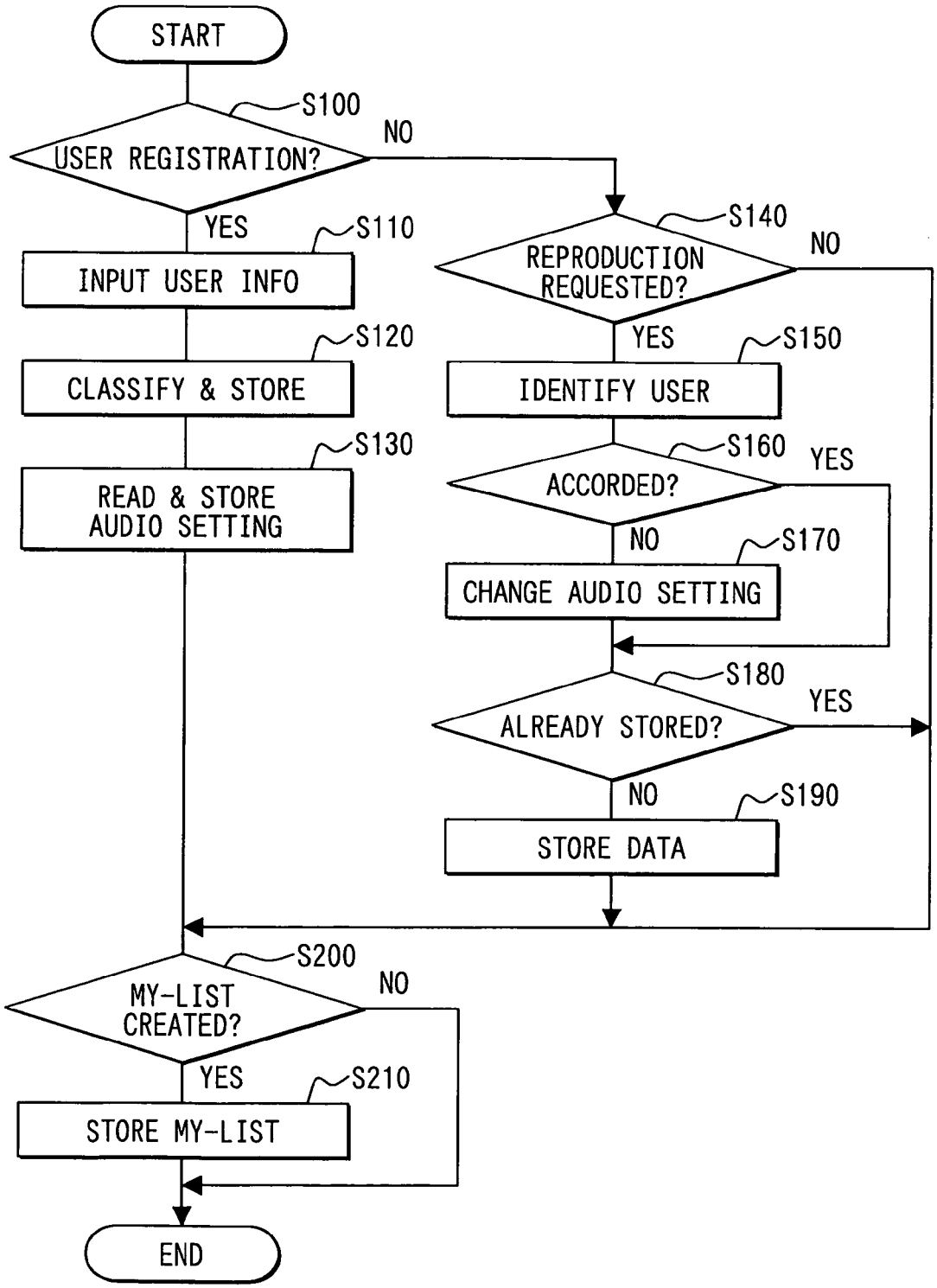
FIG. 5 is a flowchart diagram showing a preference data storing process in an audio system mounted in a vehicle.

Next, a preference data storing process will be explained with reference to FIG. 5.

At Step S100, it is determined whether an operation for user registration is conducted. Namely, whether a speech operation or switch operation for user registration is done is determined. When this determination is affirmed, the sequence goes to Step S110, where inputting user information is requested. This user information indicates musical preference of the user and includes a preferred artist, a preferred music genre, and user data such as an age and a gender. The center 140 extracts a music composition meeting the user's preference by obtaining these information items.

At Step S120, the inputted user information is classified with respect to user IDs and then stored. This user ID is notified by speech to the user, and thereafter this user ID is required to input when a music composition is reproduced in the audio system 110. Here, if user identification is performed by the user's voice pattern or the like, inputting the user ID can be unnecessary.

At Step S130, reproduction condition or audio setting information in the audio system 110 is required to set to the user's preference. Then, the set audio setting information is read and stored.

In contrast, when at Step S110, it is determined that the operation for user registration is not conducted, the sequence goes to Step S140. Here, it is determined whether reproduction for a music composition is requested. When this determination is affirmed, at Step S150 user identification is conducted by inputting the user ID or the voice pattern.

At Step S160, it is determined whether current audio setting information accords with that of the identified user. When this determination is negated, at Step S170 the reproduction condition in the audio system 110 is changed based on the stored audio setting information for the identified user.

At Step S180, it is determined whether a music composition that is requested to be reproduced is already stored or not. For instance, stored music compositions are listed. Whether a music composition that is requested to be reproduced is already stored is determined by whether the relevant music composition is included in the list. When the music composition is not already stored, the related database of the music composition is stored in the preference database 250 at Step S190. Here, the reproduced music composition related data includes a name, an artist name, a label name, a music genre, a date and hour when reproduced, a weather condition in which reproduced, and a place where reproduced. Within them, a date and hour, a season, a weather condition, and a place are obtained from the navigation device 150.

At Step S200, it is determined whether My-List is created. This My-List is formed by grouping multiple favorite music compositions. The user groups multiple specific music compositions from music compositions stored in the contents database 270 of the HDD 115, so the user can reproduce the music compositions included in the group with easy operation. Multiple My-Lists can be created. The determination at Step S200 is affirmed, My-List is stored in the preference database 250 at Step S210.

Next, a process of the center 140 will be explained with reference to FIG. 6. In this process, the center 140 obtains the preference data from the vehicle 100, and sends music composition data meeting the user's preference.

At Step S300, the center 140 outputs a transmission request of the preference data. For instance, the transmission request is outputted periodically to the vehicle 100. When the control unit 116 receives the transmission request at Step S310, the control unit 116 sends My-List and the preference data stored in the preference database 250. Further, the control unit 116 obtains a date and hour, a season, a weather condition, a place, or the like from the navigation device 150 to then send the foregoing along with the preference data at step S320. Here, the preference data which is once sent is deleted from the preference database 250.

When the center 140 receives, at Step S330, the preference data sent from the vehicle 100, the center 140 retrieves a music composition meeting the preference data from the music composition information database 144 at Step S340. This music composition retrieving process will be explained with reference to a flowchart diagram of FIG. 7.

Figure 7:
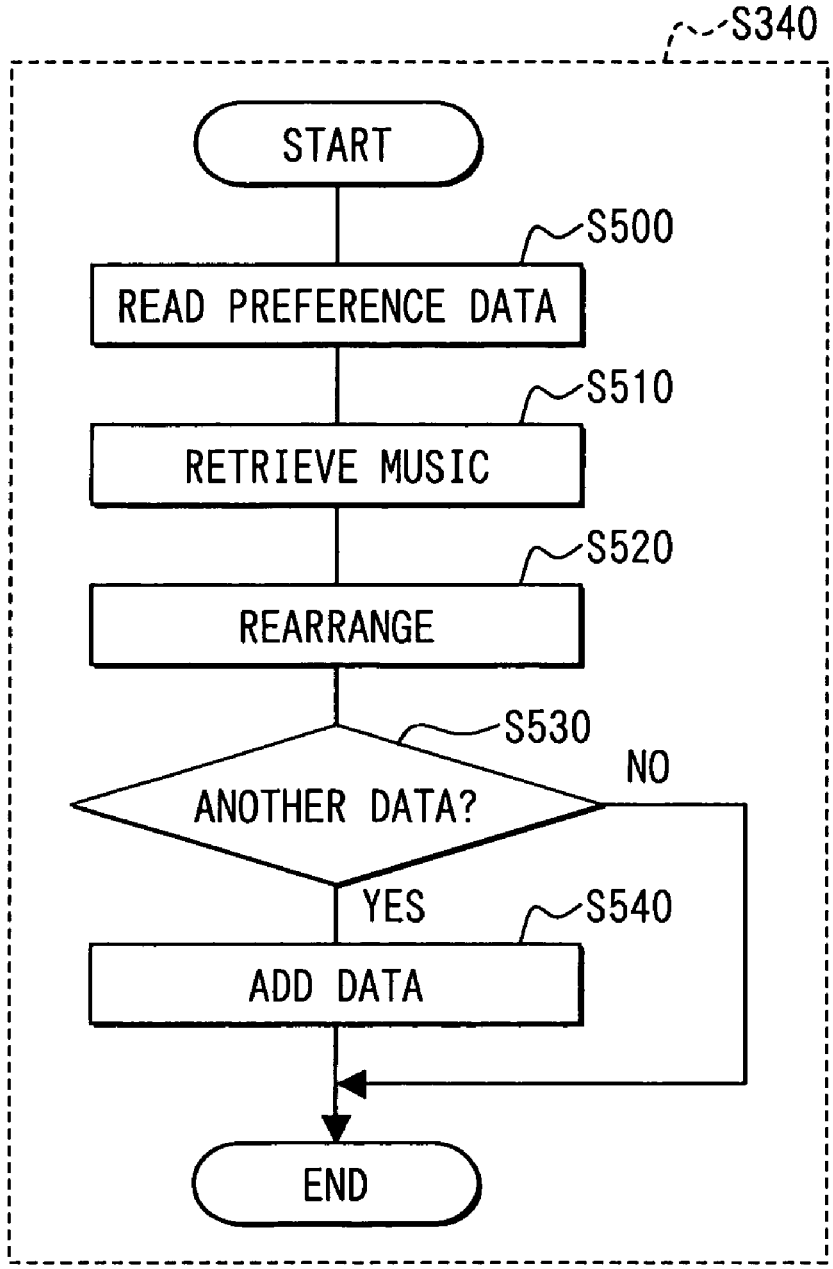
FIG. 7 is a flowchart diagram showing a music composition retrieving process.

As shown in FIG. 7, at Step S500, the preference data is read from the received data. Namely, as the preference data, the user information and the reproduced music composition related data. At Step S510, music compositions corresponding to the items included in the preference data are retrieved from the music composition information database 144. Here, the items are an artist name, a label name, a music genre, a data and hour, a season, a weather condition, and a place. At Step S520, the retrieved music compositions are rearranged in an order of the number of the items to which the individual music compositions correspond, to thereby create a music composition introduction list.

At Step S530, it is determined whether there is data of a certain another user that has a commonality in the preference data or whether there is music composition data that has dependence on a date and hour when the user is present and a place where the user is present. When this determination is affirmed, at Step S540 music compositions are extracted from the reproduced music composition related data and My-List of the certain user who has the commonality in the preference data with the subject user. Then, of the extracted music compositions, music compositions that are not included in the subject user's reproduced music composition related data and My-List data are selected and added in the music composition introduction list. Further, when there are music compositions having dependence on the date and hour when the user is present and the place where the user is present, these music compositions are extracted and then, of the extracted music compositions, music compositions that are not included in the subject user's reproduced music composition related data and My-List data are selected and added in the music composition introduction list.

Thus, the music composition introduction list is produced, and then data of a part of a music composition selected by the priority order of the music composition introduction list is sent to the vehicle 100 at Step S350. The data of the part of the music composition includes a part of introduction of the music composition or a featured part of the music composition.

Figure 6:
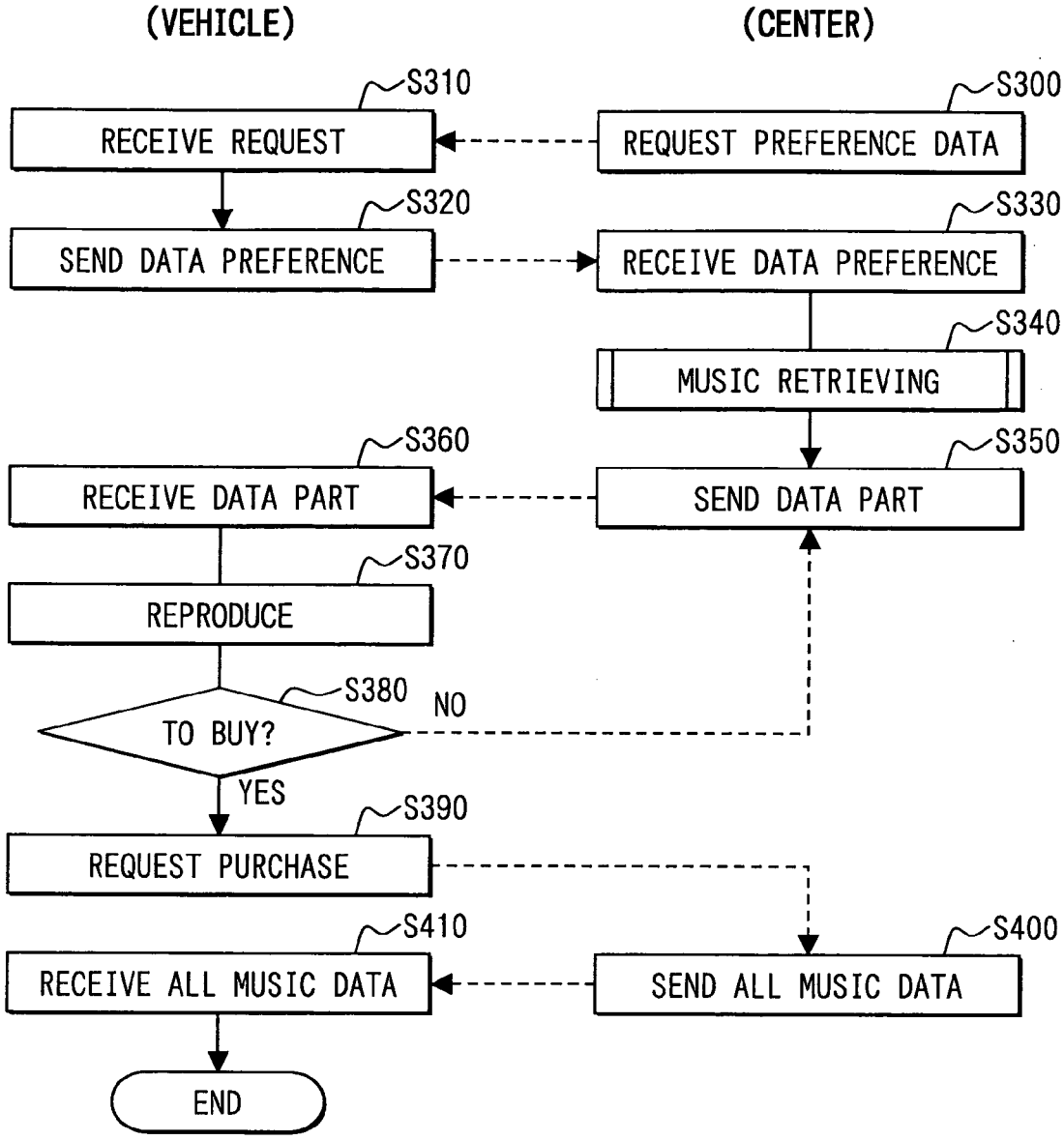
FIG. 6 is a flowchart diagram showing a music composition transmission process between a vehicle and a music composition management center.

Back to FIG. 6, in the vehicle 100, at Step S360, the part of the music composition data is received. At Step S370, it is determined whether the user who previews (or listens to) the part of the music composition as a demo wants to buy all the data of the relevant music composition. This is determined based on whether a purchase determination signal from the operating unit 112 is present. When no purchase determination signal is present even after demo of the part of the data of the music composition is complete, transmission of data of a next music composition is requested to the center 140. When the center 140 receives the request, the next music composition data is selected from the music composition introduction list and then sent to the vehicle 100. Here, when no next data is present in the music composition introduction list any more, an effect that no more music composition to be introduced is sent to the vehicle 100.

In contrast, when it is determined that the user wants to buy all the music composition data, a purchase request signal for requesting buying of all the data of the demo is sent to the center 140. According to the request signal, the center 140 extracts all the data of the music composition that the user wants to buy and sends it. The vehicle 100 receives all the data of the music composition and stores it in the HDD 115. This ends the purchase of the music composition.

Further, a payment method for this purchase can be any known method such as using a credit card, or using a prepaid card. Buying music compositions can be conducted with respect to each music composition or multiple music compositions in a lump. For instance, when music compositions can be purchased with respect to an album, convenience for users can be enhanced.

Further, in the above embodiment, data sent from the center 140 to the vehicle 100 is data of the music composition, but it can be, for instance, a release key code that is able to read music composition data from a previously provided storage medium such as a CD. When the music composition data itself is downloaded, downloading needs a significant time depending on a communications volume. In contrast, when a release key code is sent, its transmission time can be shortened. The convenience for users can be enhanced.

It will be obvious to those skilled in the art that various changes may be made in the above-described embodiments of the present invention. However, the scope of the present invention should be determined by the following claims.

What is claimed is:

1. A music composition introduction system that extracts and introduces music composition information meeting a musical preference of each user of a plurality of users, the system comprising:

a plurality of terminals for the users; and a center that manages music composition information, wherein each of the terminals includes:

a storing unit that stores preference data relating to the musical preference of the user;

an obtaining unit that obtains, from the center, music composition information data relating to a music composition that meets the preference data;

a music reproducing unit that reproduces the music composition based on the obtained music composition information data; and a user-end communicating unit that sends the preference data to the center and receives the music composition information data from the center, wherein the center includes:

a music composition information database that stores music composition information;

a preference database that stores individual preference data for the users collected from the terminals; and a retrieving unit that (i) obtains the preference data that is stored in the storing unit of the terminal, (ii) performs, by referring to the preference database, a commonality determination as to whether there is a commonality between the obtained preference data and another preference data, and (iii) retrieves, from the music composition information database, music composition information based on the preference data and the another preference data when the commonality determination is affirmed; and a center-end communicating unit that sends the music composition information data corresponding to the retrieved music composition information to the terminal and receives the preference data from the terminals, wherein each of the terminals are provided in vehicles, and each of the vehicles comprises a navigation device for detecting a position of the each vehicle, wherein the user-end communicating unit transmits information on the detected position of the vehicle as well as the preference data to the center; and wherein the retrieving unit of the center:

(i) obtains the preference data along with the information on the position, (ii) performs, by referring to the preference database, a commonality determination as to whether there is a commonality between the obtained preference data and another preference data while considering the information on the position of the vehicle, and (iii) retrieves, from the music composition information database, music composition information based on the preference data and the another preference data when the commonality determination is affirmed.

2. The music composition introduction system of claim 1, wherein, when the music reproducing unit reproduces a music composition that is selected by the user, the storing unit stores, as the preference data, reproduced music composition related data relating to the reproduced music composition.

3. The music composition introduction system of claim 2, wherein the reproduced music composition related data includes at least one of a name of the reproduced music composition, an artist of the reproduced music composition, a music genre of the reproduced music composition, a label name of the reproduced music composition, a date and hour when the music composition is reproduced, a season when the music composition is reproduced, a weather condition when the music composition is reproduced, and a place where the music composition is reproduced.

4. The music composition introduction system of claim 1, wherein the terminal further includes a music composition storing unit that groups preferred music compositions and stores the grouped music compositions, wherein the retrieving unit extracts music composition information designated from a list of the stored grouped music compositions as music composition information that should be provided to another user.

5. The music composition introduction system of claim 1, wherein the storing unit stores registration information that includes at least one of an artist the user prefers, a music genre the user prefers, and user information.

6. The music composition introduction system of claim 1, wherein, when there are a plurality of users, the storing unit classifies and stores preference data of the plurality of users with respect to each of the users.

7. The music composition introduction system of claim 6, wherein, with respect to each of the users, the storing unit classifies and stores audio setting information in a case where the music reproducing unit reproduces a music composition.

8. The music composition introduction system of claim 1, wherein the music reproducing unit includes a storage medium storing a plurality of music composition information items that are able to be read by using a release key, and wherein the obtaining unit obtains the release key as the music composition information data.

9. The music composition introduction system of claim 1, wherein the center sends music composition information data that is able to be reproduced by the music reproducing unit and corresponds to a portion of a music composition meeting the obtained preference data, wherein, when the user who previews the portion of the music composition wants to buy the music composition, the center sends music composition information data corresponding to all of the music composition.

10. The music composition introduction system of claim 1, wherein the retrieving unit performs the commonality determination as to whether there is the commonality between the obtained preference data and the another preference data while further considering a date and hour when the user is present, wherein the retrieving unit retrieves the music composition information further based on the preference data and the another preference data when the commonality determination is confirmed, of having a same date and hour when the user is present and a same place where the user is present based on the position of the vehicle.

* * * * *